US010427903B2

(12) United States Patent
Mellin

(10) Patent No.: US 10,427,903 B2
(45) **Date of Patent: *Oct. 1, 2019**

(54) LEADING EDGE DEVICE FOR A SURFACE WINDER

(71) Applicant: The Procter & Gamble Company, Cincinnati, OH (US)

(72) Inventor: Gustav André Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 237 days.

This patent is subject to a terminal disclaimer.

(21) Appl. No.: 15/438,061

(22) Filed: Feb. 21, 2017

(65) Prior Publication Data

US 2017/0253450 A1 Sep. 7, 2017

Related U.S. Application Data

(60) Provisional application No. 62/303,448, filed on Mar. 4, 2016.

(51) Int. Cl.

| | |
|---|---|
| ***B65H 19/30*** | (2006.01) |
| ***A47K 10/16*** | (2006.01) |
| ***B65H 19/22*** | (2006.01) |

(52) U.S. Cl.

CPC ..... *B65H 19/305* (2013.01); *A47K 10/16* (2013.01); *B65H 19/2269* (2013.01)

(58) Field of Classification Search

CPC .. B65H 19/305; B65H 19/2269; B65H 23/24; B65H 23/26; B65H 20/14

See application file for complete search history.

(56) References Cited

U.S. PATENT DOCUMENTS

| | | | |
|---|---|---|---|
| 1,421,730 | A | 7/1922 | Scusa |
| 1,628,322 | A | 5/1927 | Nicholas |
| 1,870,225 | A | 8/1932 | Berry |
| 1,934,913 | A | 11/1933 | Crisp |
| 2,318,056 | A | 5/1943 | Christman |
| 2,493,590 | A | 1/1950 | Mueller et al. |
| 2,812,910 | A | 11/1957 | Egan |
| 2,877,959 | A | 3/1959 | Aaron et al. |

(Continued)

FOREIGN PATENT DOCUMENTS

| | | | |
|---|---|---|---|
| CN | 2425067 | Y | 3/2001 |
| CN | 2575068 | Y | 9/2003 |

(Continued)

OTHER PUBLICATIONS

Jones, Greg, Winding area danger reduced, Pulp and Paper Europe, vol. 7, No. 6, p. 28 (May/Jun. 2002).

(Continued)

*Primary Examiner* — William A. Rivera
(74) *Attorney, Agent, or Firm* — Andrew J. Mueller

(57) ABSTRACT

A leading edge device for incorporation into an introductory portion a concave cradle is disclosed d. The concave cradle is associated with an upper winding roller of a surface winder to form a winding cradle for winding a web material having a velocity, v, around a core having a radius, R, inserted therein to obtain a log. The leading edge device has a surface having a texture provided thereto for contacting the core.

20 Claims, 11 Drawing Sheets

(56) References Cited

U.S. PATENT DOCUMENTS 2,913,098 A 11/1959 Zellinsky et al.
3,258,136 A 6/1966 Leonard et al.
3,290,861 A 12/1966 Prager
3,345,010 A 10/1967 Francis
3,494,566 A 2/1970 Pawelczyk
3,498,557 A 3/1970 Ball
3,516,620 A 6/1970 Lenten
3,539,127 A 11/1970 Grawey
3,610,545 A 10/1971 Reifenhauser et al.
3,630,462 A 12/1971 Nordgren et al.
3,680,804 A 8/1972 Aaron et al.
3,733,035 A 5/1973 Schott
3,791,602 A 2/1974 Isakson
3,869,046 A 3/1975 Gerhart
3,908,923 A 9/1975 Salgo
4,223,851 A 9/1980 Lewallyn
4,299,358 A 11/1981 Dropczynski et al.
4,327,877 A 5/1982 Perini
4,370,193 A 1/1983 Knauthe
4,408,727 A 10/1983 Dropczynski
4,422,588 A 12/1983 Nowisch
4,428,543 A 1/1984 Kuhn
4,485,979 A 12/1984 Dropczynski
4,487,377 A 12/1984 Perini
4,500,044 A 2/1985 Schnell
4,516,735 A 5/1985 Snygg
4,541,583 A 9/1985 Forman et al.
4,583,698 A 4/1986 Nistri et al.
4,609,162 A 9/1986 Kataoka
4,723,724 A 2/1988 Bradley
4,828,195 A 5/1989 Hertel et al.
4,856,752 A 8/1989 Linn
4,962,897 A 10/1990 Bradley
4,988,052 A 1/1991 Urban
5,104,055 A 4/1992 Buxton
5,104,155 A 4/1992 Kirkwood
5,137,225 A 8/1992 Biagiotti
5,222,679 A 6/1993 Dropczynski et al.
5,226,611 A 7/1993 Butterworth et al.
5,249,756 A 10/1993 Biagiotti
5,259,910 A 11/1993 Biagiotti
5,267,703 A 12/1993 Biagiotti
5,285,979 A 2/1994 Francesco
5,312,059 A 5/1994 Membrino
5,368,252 A 11/1994 Biagiotti
5,368,253 A 11/1994 Harley
5,370,335 A 12/1994 Vigneau
5,402,960 A 4/1995 Oliver et al.
5,421,536 A 6/1995 Hertel et al.
5,431,357 A 7/1995 Rueegg
5,478,027 A 12/1995 Alexander
5,505,405 A 4/1996 Vigneau
5,538,199 A 7/1996 Biagiotti
5,542,622 A 8/1996 Biagiotti
5,593,106 A 1/1997 Cavanagh
5,603,467 A 2/1997 Perini et al.
5,614,059 A 3/1997 Boriani et al.
5,641,356 A 6/1997 Delmore et al.
5,653,401 A 8/1997 Biagiotti et al.
5,690,296 A * 11/1997 Biagiotti ..... B65H 18/28 242/521
5,769,352 A * 6/1998 Biagiotti ..... B65H 19/2269 242/521
5,772,149 A 6/1998 Butterworth
5,779,180 A 7/1998 Smedt et al.
5,820,064 A 10/1998 Butterworth
5,839,680 A 11/1998 Biagiotti
5,845,867 A 12/1998 Hould et al.
5,853,140 A 12/1998 Biagiotti
5,875,989 A 3/1999 Alexander
5,909,856 A 6/1999 Myer et al.
5,979,818 A 11/1999 Biagiotti et al.
6,000,657 A 12/1999 Butterworth
6,056,229 A 5/2000 Daul et al.
6,129,304 A 10/2000 Biagiotti
6,145,777 A 11/2000 Zach et al.
6,155,515 A 12/2000 Doerfel et al.
6,286,419 B1 9/2001 Wallace
6,422,501 B1 7/2002 Hertel et al.
6,494,398 B1 12/2002 De Matteis et al.
6,517,024 B1 2/2003 Gambini
6,565,033 B1 5/2003 Biagiotti
6,595,458 B1 7/2003 Biagiotti
6,595,459 B2 7/2003 Hanson
6,629,662 B2 10/2003 Howden et al.
6,655,629 B1 12/2003 Acciari
6,659,387 B2 12/2003 Biagioni et al.
6,676,063 B2 1/2004 Gambini
6,698,681 B1 3/2004 Guy et al.
6,715,709 B2 4/2004 Stephens et al.
6,729,572 B2 5/2004 Baggot et al.
6,752,344 B1 6/2004 Biagiotti
6,752,345 B2 6/2004 Betti et al.
6,866,220 B2 3/2005 Sosalla et al.
6,877,689 B2 4/2005 Butterworth
6,926,224 B2 8/2005 Foehr et al.
6,945,491 B2 9/2005 Gambini
6,948,677 B2 9/2005 Biagiotti
6,966,521 B2 11/2005 White
7,175,126 B2 2/2007 Perini
7,175,127 B2 2/2007 Butterworth et al.
7,222,813 B2 5/2007 Tsai
7,318,562 B2 1/2008 Biagiotti et al.
7,338,005 B2 3/2008 Biagiotti et al.
7,350,739 B2 4/2008 Maddaleni et al.
7,398,942 B2 7/2008 Benvenuti et al.
7,404,529 B2 7/2008 Biagiotti et al.
7,469,856 B1 12/2008 Tsai
7,494,086 B2 2/2009 Tsai
7,523,884 B2 4/2009 Gelli et al.
7,775,476 B2 8/2010 Recami et al.
7,802,748 B2 9/2010 De Matteis et al.
7,832,676 B2 11/2010 Gelli
7,887,003 B2 2/2011 Maddaleni et al.
7,891,598 B2 2/2011 Maddaleni et al.
7,896,284 B2 3/2011 Morellie et al.
7,931,226 B2 4/2011 Benvenuti et al.
7,947,153 B2 5/2011 Tsai
8,011,612 B2 9/2011 Gelli et al.
8,181,897 B2 5/2012 Tsai
8,186,612 B2 5/2012 Gelli et al.
8,210,462 B2 7/2012 Wojcik et al.
8,215,086 B2 7/2012 Maddaleni et al.
8,267,344 B2 9/2012 Maddaleni et al.
8,282,032 B2 10/2012 Tsai
8,302,900 B2 11/2012 Gambini
8,424,481 B2 4/2013 Tsai
8,459,587 B2 6/2013 Wojcik et al.
8,807,066 B2 8/2014 Räikkönen
8,882,020 B2 11/2014 Lupi et al.
8,979,013 B2 3/2015 Gambini
9,365,379 B2 6/2016 Mazzaccherini et al.
9,586,779 B2 3/2017 Lupi et al.
9,604,810 B2 3/2017 Jendroska et al.
2003/0001042 A1 1/2003 Betti et al.
2005/0173585 A1 8/2005 Casella
2008/0111017 A1 5/2008 Gambini
2008/0223975 A1 9/2008 Planeta et al.
2008/0272223 A1 11/2008 Gambini
2009/0026299 A1 1/2009 Tsai
2009/0095836 A1* 4/2009 Maddaleni ..... B65H 19/2269 242/526
2009/0302146 A1 12/2009 Morelli et al.
2010/0133312 A1* 6/2010 Tsai ..... B65H 19/2269 226/1
2010/0163665 A1 7/2010 Gambini
2010/0163666 A1 7/2010 Gambini
2010/0237179 A1 9/2010 De Matteis
2011/0133015 A1 6/2011 Gelli et al.
2012/0048985 A1 3/2012 Gambini
2013/0008995 A1 1/2013 Langella
2013/0020427 A1 1/2013 Gelli et al.
2013/0221150 A1 8/2013 Morelli et al.
2013/0284849 A1 10/2013 Mazzaccherini et al.

(56) References Cited

U.S. PATENT DOCUMENTS

| | | | | |
|---|---|---|---|---|
| 2014/0209730 | A1 | 7/2014 | Tanaka | |
| 2016/0001997 | A1 | 1/2016 | Maddaleni et al. | |
| 2017/0253448 | A1* | 9/2017 | Mellin | A47K 10/16 |
| 2017/0253449 | A1* | 9/2017 | Mellin | B65H 19/2269 |
| 2017/0253450 | A1* | 9/2017 | Mellin | A47K 10/16 |

FOREIGN PATENT DOCUMENTS

| | | | |
|---|---|---|---|
| CN | 101983907 | A | 3/2011 |
| CN | 201857145 | U | 6/2011 |
| CN | 101891076 | B | 5/2013 |
| DE | 1228223 | B | 11/1966 |
| DE | 2721883 | A1 | 11/1978 |
| DE | 2825154 | A1 | 12/1979 |
| DE | 3151256 | A1 | 10/1982 |
| DE | 3225518 | A1 | 3/1983 |
| DE | 8322778 | U1 | 11/1985 |
| DE | 8804614 | U1 | 5/1988 |
| DE | 8806890 | U1 | 7/1988 |
| DE | 9108164 | U1 | 9/1991 |
| DE | 4042169 | A1 | 7/1992 |
| DE | 4304469 | A1 | 8/1994 |
| DE | 29610198 | U1 | 10/1997 |
| DE | 29613556 | U1 | 12/1997 |
| DE | 19630923 | A1 | 2/1998 |
| DE | 102004000040 | A1 | 5/2006 |
| EP | 0078493 | A1 | 5/1983 |
| EP | 0118384 | A1 | 9/1984 |
| EP | 0514226 | A1 | 11/1992 |
| EP | 498039 | B1 | 12/1994 |
| EP | 0638500 | B1 | 5/1997 |
| EP | 0738231 | B1 | 1/1998 |
| EP | 968946 | B1 | 3/2003 |
| EP | 2436630 | A2 | 4/2012 |
| EP | 1982939 | B1 | 7/2013 |
| EP | 2669224 | A1 | 12/2013 |
| EP | 2676906 | A1 | 12/2013 |
| EP | 2669223 | B1 | 5/2014 |
| FI | 119763 | B | 3/2009 |
| FR | 1407836 | A | 8/1965 |
| GB | 259632 | A | 10/1926 |
| GB | 322400 | A | 12/1929 |
| GB | 666317 | A | 2/1952 |
| GB | 779662 | A | 7/1957 |
| GB | 796119 | A | 6/1958 |
| GB | 808758 | A | 2/1959 |
| GB | 856037 | A | 12/1960 |
| GB | 886774 | A | 1/1962 |
| GB | 944996 | A | 12/1963 |
| GB | 1065128 | A | 4/1967 |
| GB | 1071925 | A | 6/1967 |
| GB | 1094954 | A | 12/1967 |
| GB | 1179146 | | 1/1970 |
| GB | 1190850 | A | 5/1970 |
| GB | 1224569 | A | 3/1971 |
| GB | 1281473 | A | 7/1972 |
| GB | 1282387 | A | 7/1972 |
| GB | 1324183 | A | 7/1973 |
| GB | 1435525 | A | 5/1976 |
| GB | 1557038 | A | 12/1979 |
| JP | S57117446 | A | 7/1982 |
| JP | S57156944 | A | 9/1982 |
| JP | S5863644 | A | 4/1983 |
| JP | 58074446 | A | 5/1983 |
| JP | S58152750 | A | 9/1983 |
| JP | S58216854 | A | 12/1983 |
| JP | S6052449 | A | 3/1985 |
| JP | S60118562 | A | 6/1985 |
| JP | 2000218208 | A | 8/2000 |
| JP | 2001247237 | | 9/2001 |
| JP | 2008037511 | A | 2/2008 |
| NL | 192874 | B | 12/1997 |
| SE | 533751 | C2 | 12/2010 |
| SU | 296842 | A1 | 1/1971 |
| SU | 874553 | A1 | 10/1981 |
| SU | 925823 | A1 | 5/1982 |
| WO | WO9510472 | | 4/1995 |
| WO | WO 9708088 | A1 | 3/1997 |
| WO | WO2004106201 | A1 | 12/2004 |
| WO | WO201004521 | A1 | 1/2010 |
| WO | WO201004522 | A | 3/2010 |
| WO | WO2010133037 | A1 | 11/2010 |
| WO | WO2011117827 | A1 | 9/2011 |

OTHER PUBLICATIONS

Johannsson, K., Winders—Automatic Supply of Machine Width Mandres, Revue A.T.I.P., vol. 38; Issue 4; pp. 185-7 (Apr. 1984).
PCT International Search Report, dated Jul. 11, 2017, 113 pages.
Grosskreutz, Martin, Continuous roll change in off-line calenders, Source: 88$^{th}$ Annual Meeting—Technical Section, Canadian Pulp and Paper Association, Preprints, vol. B, pp. B87-B91 (2002).

* cited by examiner

LEADING EDGE DEVICE FOR A SURFACE WINDER

FIELD OF THE INVENTION

The present disclosure relates to an apparatus for the production of convolutely wound rolls of web material. The present disclosure more particularly relates to an improvement to the leading edge of the winding cradle of a surface winding machine used for the production of rolls of convolutely wound web material wound about a core. The improved leading edge device significantly reduces the slippage of the core after its initial insertion between the concave cradle and upper winding roll of a surface winder.

BACKGROUND OF THE INVENTION

Paper is normally produced by continuously running machines that, through the delivery of a stock of cellulose fibers and water distributed from head-boxes, generate a ply of cellulose material on a forming fabric. The ply is typically dried and wound in reels having a very large diameter (known in the industry as parent rolls). These reels are subsequently unwound and rewound about a core material to form logs having a smaller diameter. The logs are subsequently divided into rolls having dimensions that are equal to the dimension of the end product. Paper products such as rolls of bath tissue, kitchen towels, or other tissue paper products are normally manufactured with this process.

Generally, rewinding machines (or rewinders) are used to produce convolutely wound rolls or "logs" of web material wound about a core. Rewinders are used to convert the large parent rolls of paper into retail sized rolls and bathroom tissue and paper towels. These rewinding machines typically wind a predetermined length of web material about a tubular winding core normally made of cardboard. These rolls, or logs, are then each cut into a plurality of smaller-size rolls intended for commercial sale and consumer use. The tubular winding core section remains inside each convolutely wound roll of web material. In both cases the end product contains a tubular core made of material that is different from that forming the web material.

Rewinding machines are generally divided into two categories depending on the manner in which the winding movement is provided. A first type of rewinding machine, known as a central spindle rewinding machine (or center winder), provides a spindle supported on support elements disposed between a pair of side walls. The center winder receives a tubular winding core on which the roll or log is formed by means of rotation of the spindle which, for this purpose, is typically associated with a drive means. The winding movement of the web material about the core is provided centrally by the spindle.

A second type of rewinding machine, known as a surface rewinding machine (or surface winder), uses the rotational movement of the tubular core (on which the roll or log is formed) provided by peripheral members in the form of rollers or rotating cylinders and/or belts. The roll or log is kept in contact with the rollers or rotating cylinders and/or belts during log formation. Exemplary surface winders are disclosed in U.S. Pat. Nos. 3,630,462; 3,791,602; 4,541,583; 4,723,724; 4,828,195; 4,856,752; 4,909,452; 4,962,897; 5,104,155; 5,137,225; 5,226,611; 5,267,703; 5,285,979; 5,312,059; 5,368,252; 5,370,335; 5,402,960; 5,431,357; 5,505,405; 5,538,199; 5,542,622; 5,603,467; 5,769,352; 5,772,149; 5,779,180; 5,839,680; 5,845,867; 5,909,856; 5,979,818; 6,000,657; 6,056,229; 6,565,033; 6,595,458; 6,595,459; 6,648,266; 6,659,387; 6,698,681; 6,715,709; 6,729,572; 6,752,344; 6,752,345; and 6,866,220. Additionally, exemplary surface winders are discusses in International Publication Nos. 01/16008 A1; 02/055420 A1; 03/074398 A2; 99/02439; 99/42393; and EPO Patent Application No. 0514226 A1.

Generally, a surface winder is comprised of three principle winding rolls that perform the surface winding process. These rolls are known to those of skill in the art as the first winding roller (or upper winding roll (UWR)), the second winding roller (or lower winding roll (LWR)), and the third winding roller (or rider roll (RR)). These respective rolls are named due to where, or how, they contact a winding log. The UWR and LWR contact the winding log on the upper and lower portions respectively and the RR "rides" on the upper portion of the winding log as it increases in diameter as web material is wound thereabout. The core enters the surface winder and is typically adhesively attached to a web material to be wound thereabout in a region of compression disposed between the UWR and LWR. The winding log (core plus any web material convolutely wound thereabout) is initially rotated by the UWR in a region disposed between the UWR and a stationary core cradle. The winding log is then rotationally translated to a region disposed intermediate the rotating, but stationary, UWR and LWR (known as the winding nest region). The RR contacts the surface of the rotating winding log in the winding nest region and translates away from the UWR and LWR as web material continues to be convolutely wound about the winding log (core plus all web material convolutely wound thereabout).

In an exemplary surface wind system, a web material is convolutely wound about a paperboard core of 1.5" to 1.7" diameter and of a length that corresponds to the width of the tissue parent roll which comes from the paper machine, usually in width from 65" to 155".

However useful, current surface winders do have known limitations. As shown in FIG. 1, when a core is inserted into the region between the UWR and the cradle prior to insertion into the winding nest area, the core must undergo a transformation where the surface speed of the core must be accelerated from zero (i.e., has no surface speed at the point of entry) to the surface speed of the UWR (i.e., UWR running speed). In other words, the surface speed of the core is accelerated from zero to the surface speed of the UWR while disposed within the region between the cradle and the UWR. However, it has been observed that several mechanics-related principles in this region of a surface winder can act to impact motion of the core through this introductory region of the surface winder to retard this required surface speed acceleration.

First, the entry portion of the cradle positioned at a fixed point disposed orbitally about the UWR typically has a smooth surface. An exemplary entry point is shown in FIG. 2. The placement of a core having zero surface speed into the entry point of the winding cradle and the ensuing contact with the web material in contact with the UWR can (and generally will) cause the core to slip (i.e., not spin and laterally translate) against this initial portion of the winding cradle. This slippage is represented by the arrow labeled "S" in FIG. 3. This slippage is believed to cause the core to oblongly deform into an ellipsoid shape.

Second, the glue-laden core is targeted to contact the web material in contact with the UWR at a predetermined location by the requirements of the winding process. Typically the targeted contact location on the web material is disposed immediately adjacent a perforation between two separable sheets of web material. If this targeted attachment location changes, several unfavorable results can occur in the early stage formation of the convolutely wound material.

For example, if the web attachment point occurs at a point removed backwards from the region near the perforation (e.g., behind the perforation), any excess leading web material will 'fold-back' upon the core and overlap the region of actual attachment of the web material to the core. This causes a consumer undesirable and unattractively wound product.

If the web attachment point occurs at a point removed forwards from the region near the perforation (e.g., ahead of the perforation), the web material can fail to attach to the core. This can result in the deposition of the adhesive disposed upon the core material (e.g., the so-called core glue) upon the manufacturing equipment. Ultimately, this can result in a build-up of core glue upon the surfaces of the process equipment and result in a process shut-down. Not only will the web material need to be re-threaded though the converting equipment, but adhesive will also have to be manually removed from the surfaces of the rewinding equipment such as the winding cradle and UWR.

Thus, there is a clearly defined need to increase the acceleration of the core surface speed at the point of insertion of the core into the winding cradle to prevent the drawbacks observed by current surface winding equipment that meets current manufacturing financial and processing targets.

SUMMARY OF THE INVENTION

The present disclosure provides for an improvement to a surface winder for winding a web material around a core having a radius, R, to obtain a log. The surface winder comprises a glue applicator for dispensing glue onto the core, a core inserter for transporting and inserting the core provided with the glue disposed thereon into a winding cradle defined at a top by an upper winding roller, supplied from above with the web material directed towards the winding cradle at a velocity, v, and at a bottom by a concave cradle associated downstream to a lower winding roller. The surface winder further comprises a third oscillating roller arranged above the lower winding roller. The upper winding roller, the lower winding roller, and the third oscillating roller each have a respective axis parallel to each other and perpendicular to the feeding direction of the web material and cooperating with each other downstream of the winding cradle in order to wind the web material around the core to obtain the log. The concave cradle comprises an introductory portion. The introductory portion of the concave cradle comprises a leading edge device. The leading edge device has a surface for contacting the core and has a texture provided thereto.

The present disclosure also provides for a leading edge device for incorporation into an introductory portion a concave cradle. The concave cradle is associated with an upper winding roller of a surface winder to form a winding cradle for winding a web material having a velocity, v, around a core having a radius, R, inserted therein to obtain a log. The leading edge device has a surface having a texture provided thereto for contacting the core.

DETAILED DESCRIPTION

Figure 1:
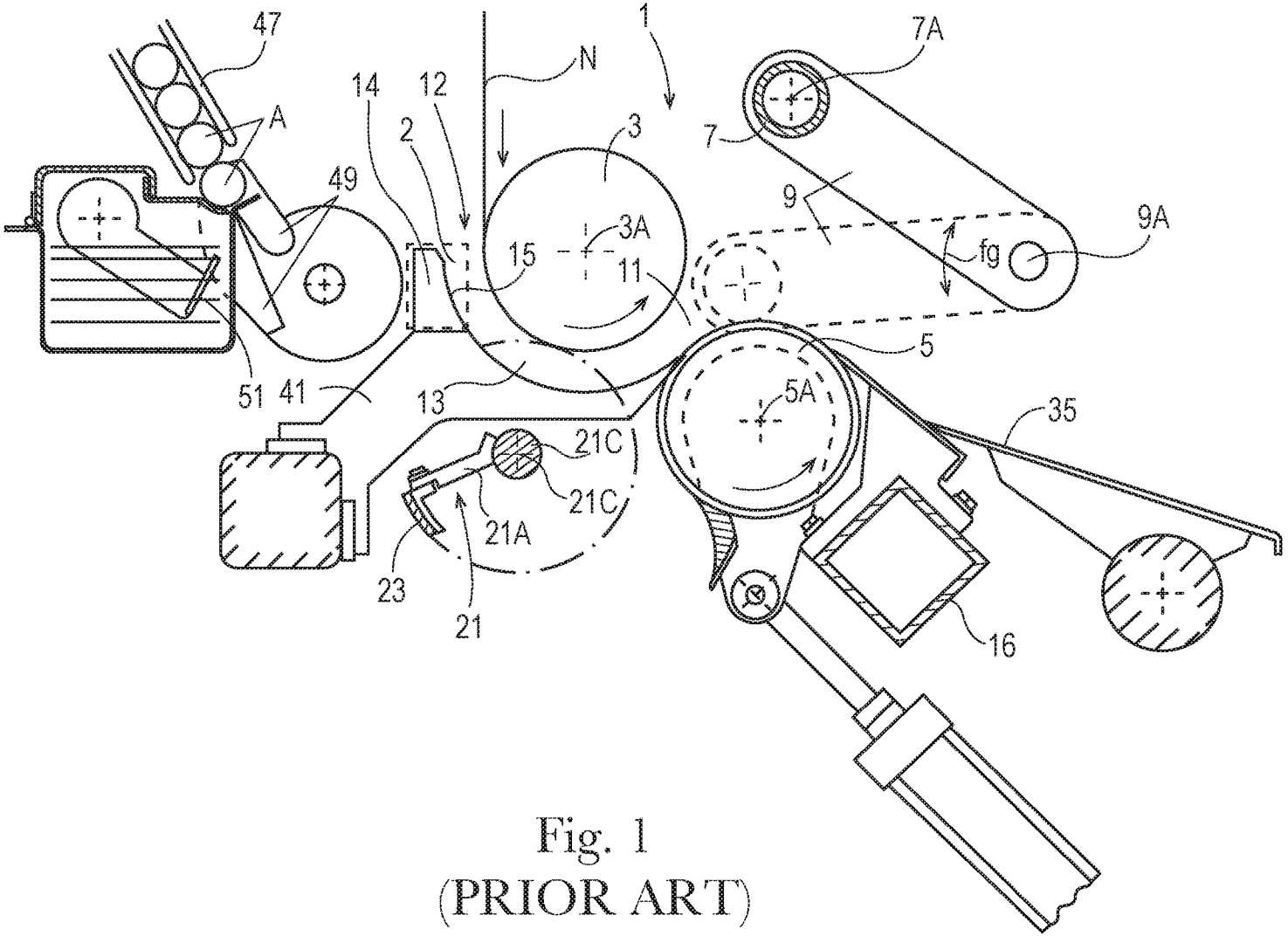
Fig. 1 (PRIOR ART)
FIG. 1 is a cross-sectional view of an exemplary surface rewinding machine.
Figure 2:
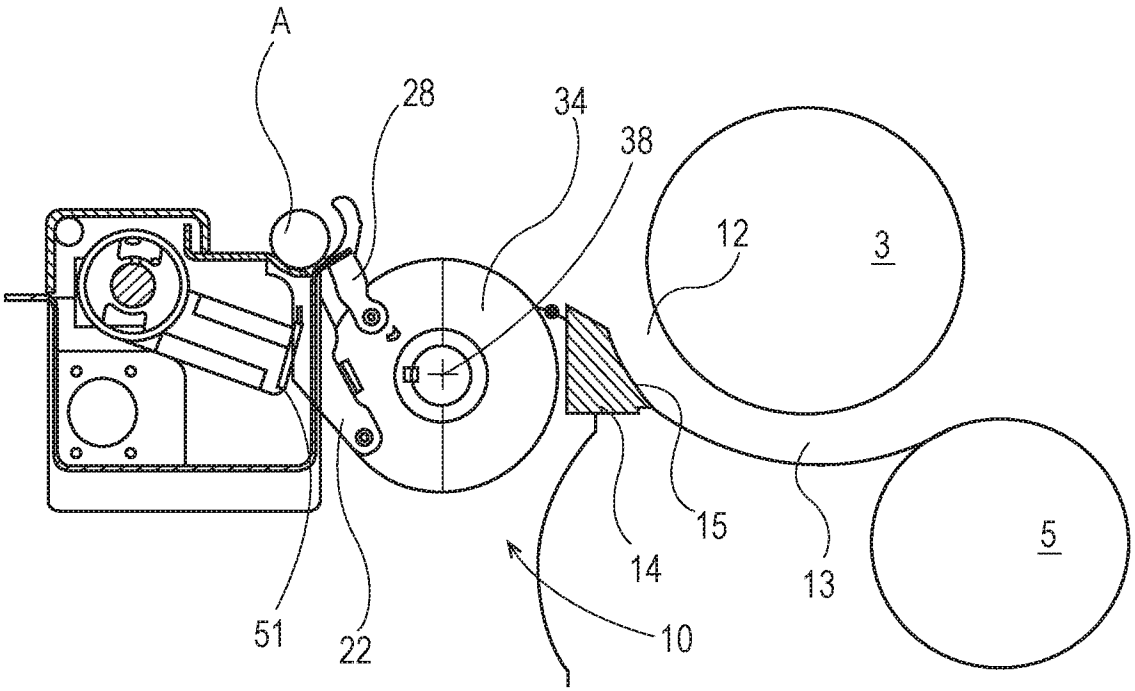
Fig. 2 (PRIOR ART)
FIG. 2 is a cross sectional view of an exemplary prior art surface winder including a core in-feed apparatus showing an initial stage of the transport of a winding core that has glue disposed upon a surface thereof.
Figure 3:
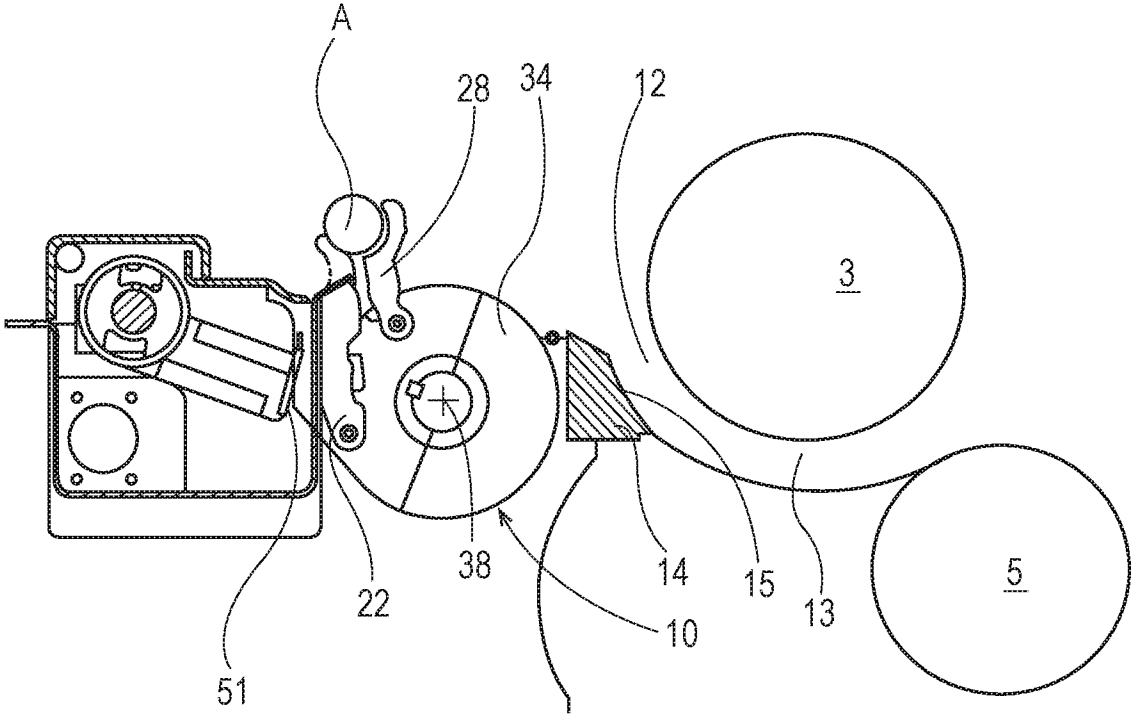
Fig. 3 (PRIOR ART)
FIG. 3 is a cross sectional view of an exemplary prior art surface winder including a core in-feed apparatus showing a second stage of the transport of a winding core that has glue disposed upon a surface thereof.
Figure 4:
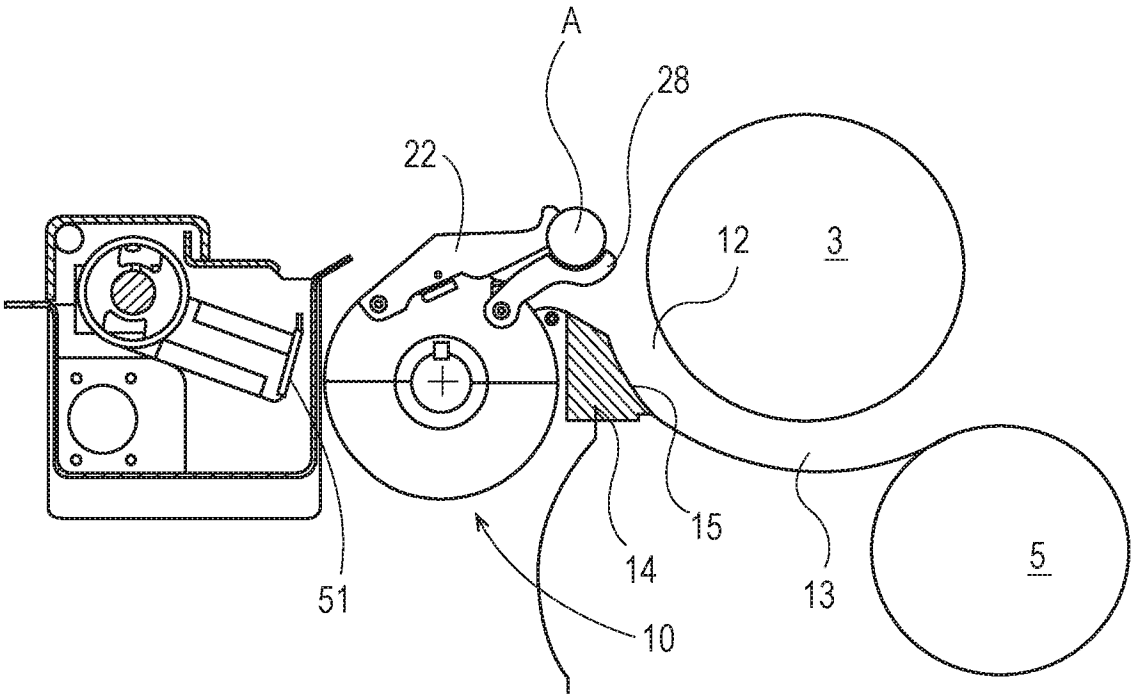
Fig. 4 (PRIOR ART)
FIG. 4 is a cross sectional view of an exemplary prior art surface winder including a core in-feed apparatus showing a third stage of the transport of a winding core that has glue disposed upon a surface thereof.
Figure 5:
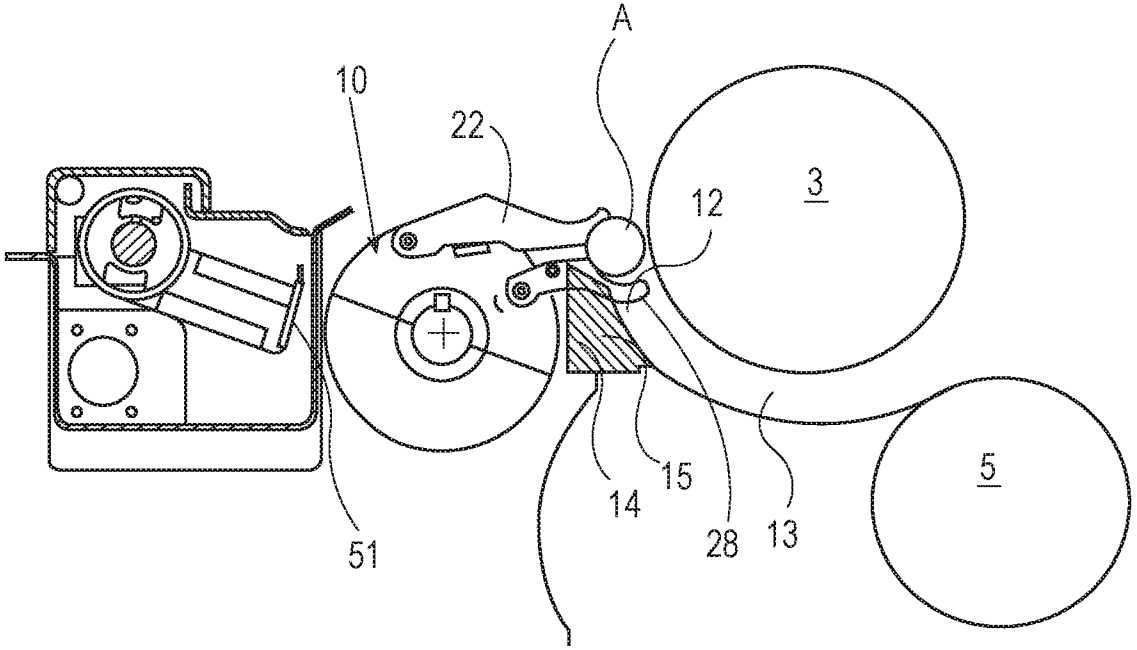
Fig. 5 (PRIOR ART)
FIG. 5 is a cross sectional view of an exemplary prior art surface winder including a core in-feed apparatus showing a fourth stage of the transport of a winding core that has glue disposed upon a surface thereof where the winding core is presented at the introductory portion of a winding cradle.
Figure 6:
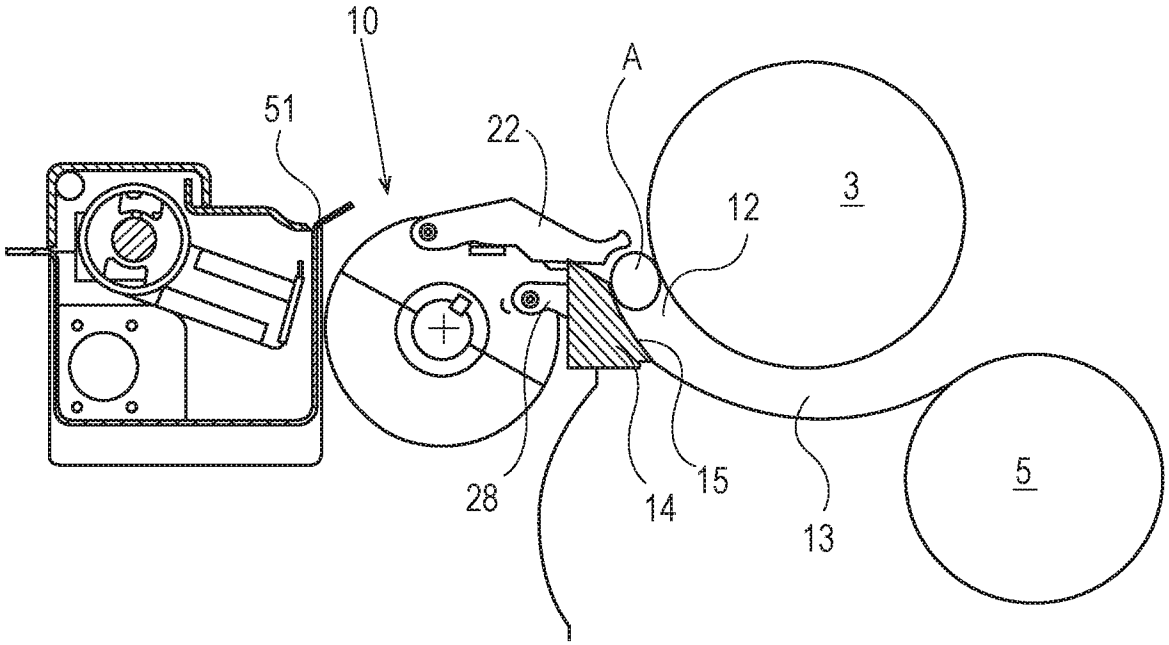
Fig. 6 (PRIOR ART)
FIG. 6 is a cross sectional view of an exemplary prior art surface winder having a winding core disposed at the introductory portion of a winding cradle.

An exemplary embodiment of a prior art rewinder is shown in FIG. 1. As presented, FIG. 1 shows the main members of the rewinder, and in particular the members intended to feed the winding cores A and the winding rollers.

The winding head of the exemplary prior art rewinder is generically indicated with 1. In this exemplary embodiment, the winding head of the rewinding machine comprises a first winding roller 3 (also referred to herein as upper winding roll 3) with a rotation axis 3A, a second winding roller 5 (also referred to herein as lower winding roll 5) rotating about a rotation axis 5A and a third winding roller 7 (also referred to herein as rider roll 7) rotating about a third rotation axis 7A. A nip 11 is defined between the two winding rollers 3 and 5 for passage of the web material, having a speed, v, which can be equal to the surface speed of upper winding roll 3, wound about a core A.

In some embodiments the axis 3A of the first winding roller 3 is fixed with respect to a load bearing structure (not shown) of the rewinder. In other embodiments the axis 3A can be moving with respect to the load bearing structure (not shown).

In some embodiments the axis 5A of the second winding roller 5 is movable. In some embodiments the axis 5A can be moved to produce logs with a winding core A. In other embodiments, the rotation axis 5A of the second winding roller 5 can be movable in a controlled manner also during each winding cycle of logs upon a core A having a variable diameter. Ideally, the axis 5A of the second winding roller 5 can be movable to adapt the machine to winding cores A or mandrels having different diameters. In any regard, the first winding roller 3 can have a moving axis 3A for the same reasons indicated above. Further, both the winding rollers 3 and 5 can be movable and adjustable.

The third winding roller 7 is advantageously carried, for example, by a pair of arms 9 pivoting with a reciprocating movement according to the double arrow f9 about a pivoting axis 9A. The movement according to the double arrow f9 enables the third winding roller 7 to move toward or away from the first winding roller 3 and second winding roller 5 according to the diameter of the log L during the step of formation inside the winding cradle defined by the three winding rollers 3, 5 and 7.

The exemplary prior art rewinding machine 1 can be provided with a concave cradle 41. The concave cradle 41 is in actual fact preferably formed by a series of mutually parallel shaped plates, only one of which is visible in the drawing and the others being superimposed thereon. The various shaped plates all have a concave edge forming a concave surface for rolling of the winding cores.

The winding cores A are fed along a feeder 47. Single winding cores A can be picked up by a core inserter 49 after a longitudinal line of glue has been applied thereto by a glue applicator 51. The machine in this arrangement has substantially the same structure and operation as that described in U.S. Pat. No. 5,979,818 and therefore the operating cycle will not be described in detail.

As shown in FIGS. 2-6, cam housing 34 of core inserter 10 can be provided with a cam disposed within cam housing 34 that defines the orbital motion of movable finger 28 attached thereto about the longitudinal axis of core inserter 10. The cam can be provided with any desired profile required by the manufacturing operation to provide the desired motion about the longitudinal axis 38.

In this regard, movable finger 28 can emanate from a centroid of cam housing 34 in a manner that causes cam housing 34 to orbit about the longitudinal axis 38 of cam-controlled core inserter 10. As cam housing 34 orbits about the longitudinal axis 38 while disposed in contacting and moveable engagement with cam housing 34, cam housing 34 can define the motion of movable finger 28 relative to the longitudinal axis 38, fixed finger 22, and winding core A. Without desiring to be bound by theory, it is believed that by providing a cam housing 34 system to control the movement of movable finger 28 of cam-controlled core inserter 10 can provide a more reliable and consistent contact and release system for the insertion of a winding core A into the introductory portion 12 of winding cradle 13.

As shown in FIGS. 3-6, as the fixed fingers 22 of core inserter 10 approach the introductory portion 12 of winding cradle 13, winding core A remains in contacting engagement with fixed finger 22 and movable finger 28 of cam-controlled core inserter 10 as the winding core A approaches the introductory portion 12 of winding cradle 13. Clearly, the core inserter 10 of the present disclosure is provides more certainty relative to the insertion of a winding core A into the introductory portion 12 of winding cradle 13.

Returning again to FIG. 1, the moving member 21 can be used to sever the web material N, but winding starts on the central core A and the member 21 does not perform any function in relation to this action, except for an optional effect of accompanying the leading edge toward the new winding core A that is inserted into the channel formed between the winding roller 3 and the cradle 41 upstream (with respect to the direction of feed of the web material N) of the moving member 21.

Interaction between the concave cradle 41 and the moving member 21 is permitted by the fact that the former has a comb shaped structure formed by a plurality of parallel plates. In this way, the pads 23 of the moving member 21 can pass between adjacent plates and enter the feed channel of the winding cores A formed between the concave surface 41A of the cradle 41 and the cylindrical surface 3B of the winding roller 3.

The concave cradle 41 can be supported rotating about the rotation axis 21C of the moving member 21. The moving member passes from an idle position to an operating position by pivoting about the rotation axis 21C. Pivoting can be controlled by a piston-cylinder actuator.

Moving member 21 can be provided with a reciprocating oscillatory or rotary movement around said axis. The moving member 21 rotates in clockwise direction to come into contact with the web material N and pinch it against the cylindrical surface of the winding roller 3 and perform severing of the web material N.

As mentioned previously, single winding cores A are picked up by a core inserter 49 after a longitudinal line of glue has been applied thereto by a glue applicator 51. The core inserter 49 translates the winding core A having glue disposed thereon to a point of entry into the introductory portion 12 of the surface rewinding machine disposed between the upper winding roll 3 having a web material N disposed about at least a portion thereof and the concave cradle 41. The region disposed between concave cradle 41 and upper winding roll 3 is referred to herein as winding cradle 13. The region disposed between leading edge device 14 and upper winding roll 3 forms the introductory portion 12 of winding cradle 13. While it is possible for web material N to have a velocity, v, that is different from the surface velocity of upper winding roll 3 about its longitudinal axis 3A, for purposes of discussion herein, it can be presumed that the velocity, v, of web material N is the same as the surface velocity of upper winding roll 3 about its longitudinal axis 3A.

Figure 7:
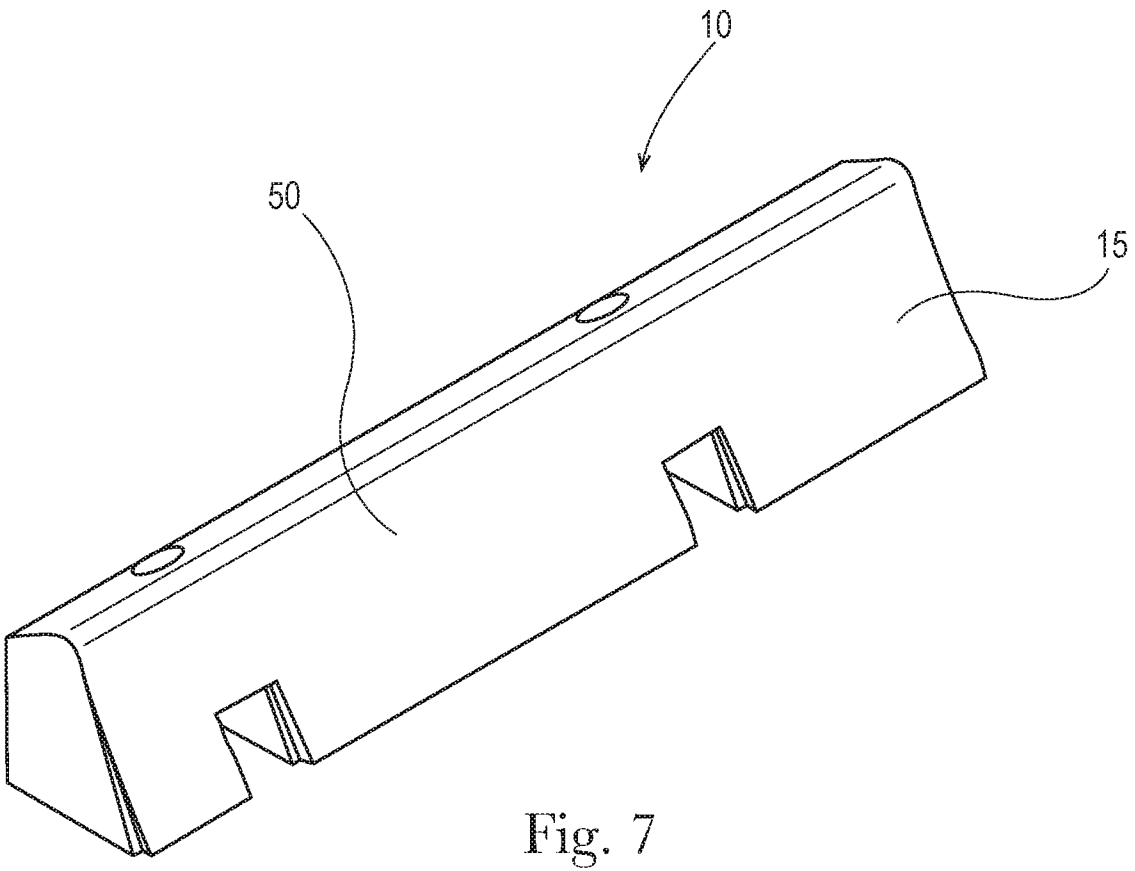
Fig. 7 (PRIOR ART)
FIG. 7 is a perspective view of an exemplary prior art introductory portion of the winding cradle of the region labeled 2 in FIG. 1 having a smooth surface.

As shown in FIG. 7, a typical leading edge device 14 is provided with a surface 15 that can be considered to have a finish texture 50 that provides a generally smooth and polished finish. Leading edge device 14 is typically affixed to the concave cradle 41.

Figure 8:
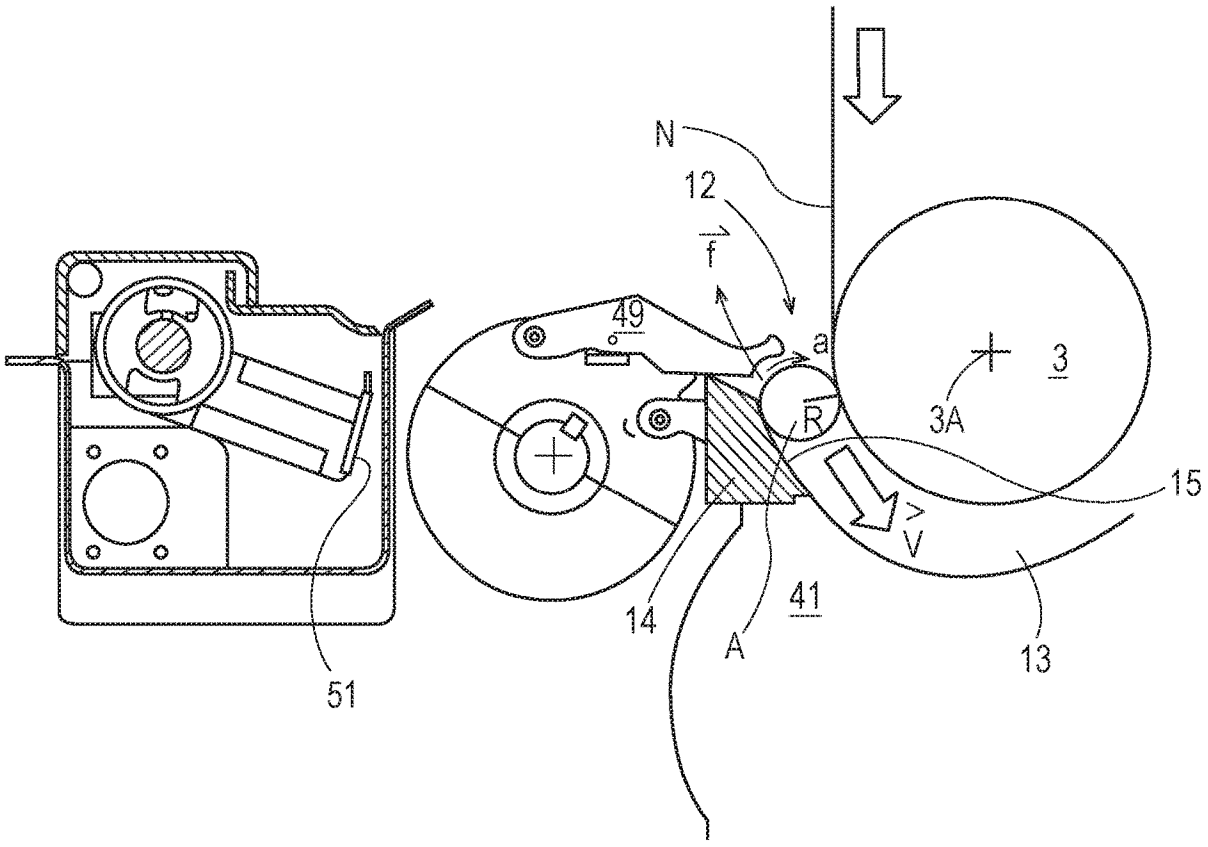
Fig. 8 (PRIOR ART)
FIG. 8 is a cross-sectional view of an exemplary surface prior art winding machine showing a core 'slipping' through the introductory portion of the surface rewinding machine while disposed between the upper winding roll and the winding cradle due to the introductory portion of the winding cradle of the region labeled 2 in FIG. 1 having a smooth surface.

As shown in FIG. 8 however, and as discussed supra, a leading edge device 14 provided with a generally smooth and polished finished surface can actually facilitate the sliding (e.g., purely translational movement and little or no rotational movement) of a winding core A disposed within the introductory portion 12 of winding cradle 13. Without desiring to be bound by theory, it is believed that winding core A initially slips, and does not immediately assume a rotational surface speed as it first contacts surface 15 of leading edge device 14 and the moving web material N having a velocity, v, contacting the surface of upper winding roll 3.

One of skill in the art will understand that when rolling of winding core A happens without slipping, the point of contact of winding core A has zero linear velocity relative to the surface 15 of leading edge device 14. When slipping (with or without rolling) of the winding core A occurs, the point of contact of winding core A with the surface 15 of leading edge device 14 has a non-zero linear velocity relative to the surface 15 of leading edge device 14. As the winding core A essentially (or effectively) slides along (or upon) the surface 15 of leading edge device 14, kinetic friction, f, eventually reduces the linear (e.g., non-rotational) velocity of winding core A relative to the surface 15 of leading edge device 14. This frictional force, f, also causes the winding core A to start rotating about its center of mass (cm). The linear velocity along the surface 15 of the leading edge device 14 of the winding core A decreases and the angular velocity, w, of winding core A increases until the non-slip condition $v_{cm}=R\omega$ is met. Then winding core A effectively rolls upon the surface 15 of leading edge device 14 about its center of mass without (or with reduced) slipping.

In other purely mechanical terms, the linear velocity, v, of the winding core A must always equal the rate of rotation, ω, of the winding core A multiplied by the radius, R, of the winding core A from the center of rotation to the point of contact of winding core A with upper winding roll 3. If the magnitude of the linear velocity at the edge of the rotating winding core A does not equal the magnitude of the linear velocity of the center of rotation of the rotating winding core A, then there must be slipping at the point of contact of winding core A with upper winding roll 3 or the surface 15 of leading edge device 14. This results in the linear, non-rotating (i.e., translational) movement of winding core A relative to the surface 15 of leading edge device 14 because the center of rotation/mass of the winding core A must move faster than the rotation of upper winding roll 3 can move it. In other words, when winding core A experiences pure translational motion, all of its points move with the same velocity as the center of mass (e.g., in the same direction and with the same speed ($v=v_{cm}$). The force of friction, f, from the surface 15 of leading edge device 14 is the only force acting upon the surface of winding core A to cause the winding core A to reduce the translational velocity, v, and increase the rotational velocity of winding core A to match the surface speed of upper winding roll 3 and web material N in contacting engagement therewith (e.g., in the rewinder described herein—also having a velocity v).

Mathematically stated, at the point of insertion of the winding core A into the introductory portion 12 of winding cradle 13 slipping and rolling forward provides $v_{cm}<R\omega$. Thus, the path of winding core A through the introductory portion 12 of winding cradle 13 forms a prolate (contracted) cycloid because it is traced out to points on the surface of the generating circle that is slipping while rolling with a velocity of $v_{cm}<R\omega$.

Therefore, one of skill in the art would understand that it can be desirable to provide the winding core A with a rotational velocity (i.e., a rolling motion) at the point of contact with upper winding roll 3 and the surface 15 of leading edge device 14. In this way, the rolling of winding core A becomes a combination of both translational and rotational motion. Thus, when the winding core A experiences pure rotational motion about its center of mass, all of its points move at right angles to the radius, R, in a plane perpendicular to the axis of rotation, so that points on opposite sides of the axis of rotation of winding core A move in opposite directions, and move with a speed proportional to radius ($v=R\omega$), so that the center of mass does not move (since R=0) and points on the outer radius of winding core A move with speed $v=R\omega$, and move in a circle centered on the axis of rotation (also the center of mass).

Figure 9:
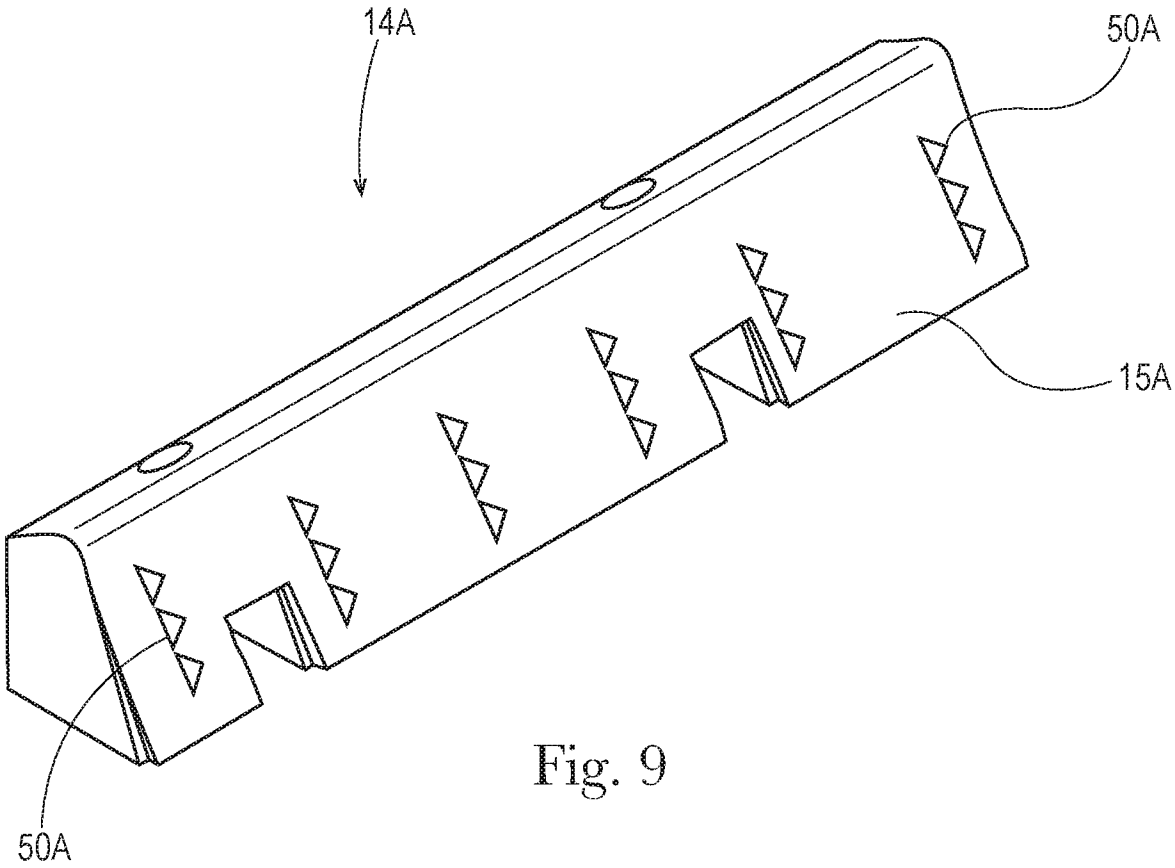
FIG. 9 is a perspective view of an exemplary leading edge device having a surface texture applied thereto in the form of pins.
Figure 10:
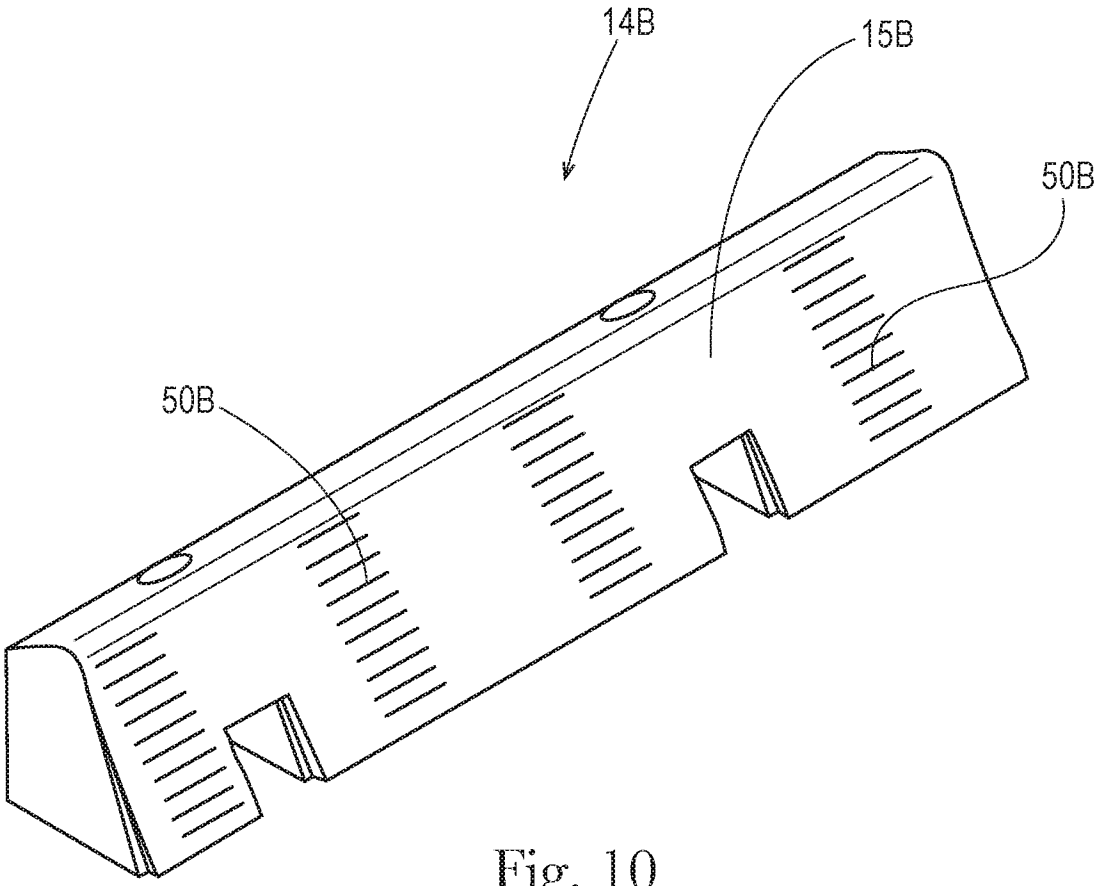
FIG. 10 is a perspective view of an exemplary leading edge device having a surface texture applied thereto in the form of linear sectioned grooves; and, FIG. 11 is a perspective view of an exemplary leading edge device having a surface texture applied thereto in the form of elongate linear grooves.
Figure 11:
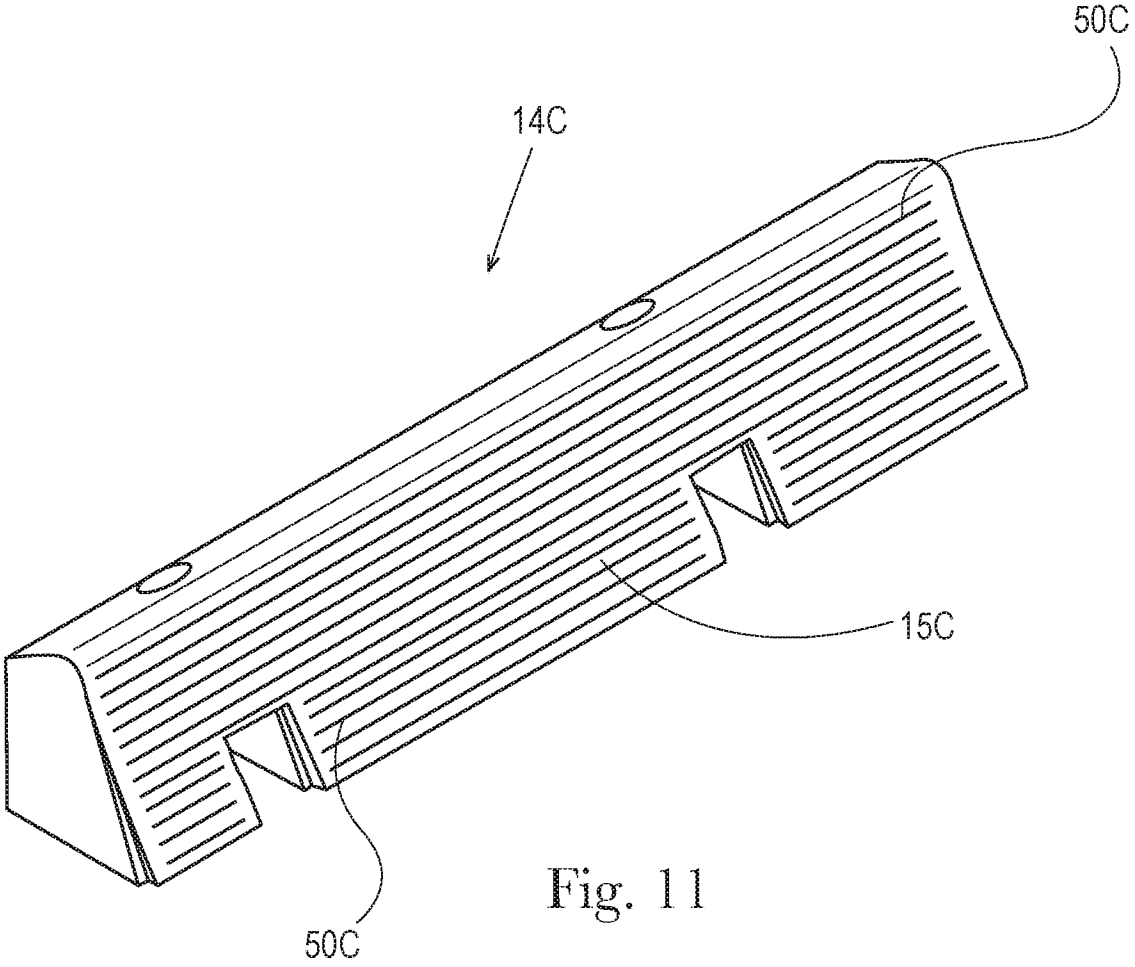

As shown in FIGS. 9-11, an exemplary leading edge device 14 can be provided with a surface 15 that has a texture 50 provided thereto. Without desiring to be bound by theory, it is believed that providing a leading edge device 14 with a finish texture 50 upon surface 15 that can reduce the slippage of a respective winding core A that will be inserted into the introductory portion 12 of winding cradle 13.

By way of non-limiting example, as shown in FIG. 9, a suitable leading edge device 14A can be provided with a surface 15A having a finish texture 50A that comprises a plurality of protuberances. Each protuberance of the plurality of protuberances can be arranged in any manner desired upon the surface 15A of leading edge device 14A required by the user in order to reduce the slippage of a respective winding core A inserted into the introductory portion 12 of winding cradle 13. For example, each protuberance of the plurality of protuberances can be randomly distributed upon the surface 15A of leading edge device 14A. Alternatively, each protuberance of the plurality of protuberances can be provided in defined patterns (as may be required by the web materials wound about the respective winding core A or by any other process parameter) that form the finish texture 50A upon the surface 15A of leading edge device 14A. For example, a finish texture 50A can be provided so that a series of protuberances of the plurality of protuberances are collectively elongate upon the surface 15A of leading edge device 14A.

Further, each protuberance can have any geometry that may be required to reduce the slippage between a respective winding core A and the surface 15A of leading edge device 14A. For example, each protuberance can be provided as a pin extending from the surface 15A of leading edge device 14A. Alternatively, each protuberance can be provided as a polyhedron having a shape that is a pyramid, a cylinder, a cone, a truncated cone, a sphere, a prism, an ellipsoid, and/or combinations thereof. Clearly, one of skill in the art will recognize that the plurality of protuberances can be provided as combinations thereof.

FIG. 10, depicts another non-limiting example of a leading edge device 14B provided with a surface 15B having a finish texture 50B that comprises a series of linear sections. The series of linear sections can be disposed upon and extend from the surface 15B of leading edge device 14B. Alternatively, the series of linear sections can be disposed upon and extend into the surface 15B of leading edge device 14B. Each series of linear sections can be disposed at any location upon the surface 15B of leading edge device 14B. Further any number of series of linear sections can be disposed at any location and/or orientation upon the surface 15B of leading edge device 14B. Additionally, linear section of a series of linear sections can be provided with any length, height, and/or depth relative to the surface 15B of leading edge device 14B.

As shown in FIG. 11, another non-limiting example of a leading edge device 14C can be provided with a surface 15C having a finish texture 50C that comprises a series of elongate grooves disposed within the surface 15C of leading edge device 14C. Alternatively, leading edge device 14C can be provided with a surface 15C having a finish texture 50C that comprises a series of elongate protuberances disposed upon the surface 15C of leading edge device 14C. Further the elongate grooves and/or protuberances can be disposed at any location, orientation, and/or distribution relative to the surface 15B of leading edge device 14B. The elongate grooves and/or protuberances can be linear, curvilinear, sinusoidal, and/or combinations thereof. The elongate grooves and/or protuberances can be used together to form a surface 15C that has both protuberances extending from the surface 15C of leading edge device 14C and grooves extending into the surface 15C of leading edge device 14C.

EXAMPLES a. An improvement to a surface winder for winding a web material around a core having a radius, R, to obtain a log, the surface winder comprising a glue applicator for dispensing glue onto said core, a core inserter for transporting and inserting said core provided with said glue disposed thereon into a winding cradle defined at a top by an upper winding roller, supplied from above with said web material directed towards said winding cradle at a velocity, v, and at a bottom by a concave cradle associated downstream to a lower winding roller, said surface winder comprising a third oscillating roller arranged above said lower winding roller, said upper winding roller, said lower winding roller, and said third oscillating roller each having a respective axes parallel to each other and perpendicular to the feeding direction of said web material and cooperating with each other downstream of said winding cradle in order to wind said web material around said core to obtain said log, said concave cradle comprising an introductory portion, the improvement comprising: wherein said introductory portion of said concave cradle comprises a leading edge device, said leading edge device having a surface for contacting said core, said surface having a texture provided thereto.

b. The improvement to a surface winder of a. wherein said surface causes said core to rotate at an angular velocity, ω, wherein $v=R\omega$.

c. The improvement to a surface winder of any of a. through b. wherein said core contacts said leading edge device concurrently with contacting said web material in contacting engagement with said upper winding roller.

d. The improvement to a surface winder of any of a. through c. wherein said texture is a plurality of protuberances disposed upon said surface of said leading edge device, said core contacting said protuberances when disposed between said leading edge device and said web material in contacting engagement with said upper winding roller.

e. The improvement to a surface winder of d. wherein each protuberance of said plurality of protuberances disposed upon said surface of said leading edge device are collectively elongate.

f. The improvement to a surface winder of d. wherein each protuberance of said plurality of protuberances disposed upon said surface of said leading edge device are disposed randomly upon said surface of said leading edge.

g. The improvement to a surface winder of d. wherein each protuberance of said plurality of protuberances disposed upon said surface of said leading edge device are disposed in a pattern upon said surface of said leading edge.

h. The improvement to a surface winder of d. wherein each protuberance of said plurality of protuberances disposed upon said surface of said leading edge device are provided with a geometry, said geometry of each of said protuberances reducing slippage between said core and said surface of said leading edge device.

i. The improvement to a surface winder of h. wherein said geometry is selected from the group consisting of pins, polyhedrons, and combinations thereof.

j. The improvement to a surface winder of any of a. through i. wherein said texture is a plurality of linear sections disposed upon said surface of said leading edge device, said core contacting said linear sections when disposed between said leading edge device and said web material in contacting engagement with said upper winding roller.

k. The improvement to a surface winder of any of a. through j. wherein said texture is a plurality of linear sections disposed within said surface of said leading edge device, said core contacting said linear sections when disposed between said leading edge device and said web material in contacting engagement with said upper winding roller.

l. The improvement to a surface winder of any of a. through k. wherein said texture is a plurality of grooves disposed upon said surface of said leading edge device, said core contacting said grooves when disposed between said leading edge device and said web material in contacting engagement with said upper winding roller.

m. A leading edge device for incorporation into an introductory portion a concave cradle, said concave cradle being associated with an upper winding roller of a surface winder to form a winding cradle for winding a web material having a velocity, v, around a core having a radius, R, inserted therein to obtain a log, said leading edge device having a surface for contacting said core, said surface having a texture provided thereto.

n. The leading edge device of m. wherein said surface causes said core to rotate at an angular velocity, ω, wherein $v=R\omega$.

o. The leading edge device of any of m. through n. wherein said core contacts said leading edge device concurrently with contacting said web material.

p. The leading edge device of any of m. through o. wherein said texture is a plurality of protuberances disposed upon said surface of said leading edge device, said core contacting said protuberances when disposed between said leading edge device and said web material in contacting engagement with said upper winding roller.

q. The leading edge device of p. wherein each protuberance of said plurality of protuberances disposed upon said surface of said leading edge device are provided with a geometry, said geometry of each of said protuberances reducing slippage between said core and said surface of said leading edge device.

r. The leading edge device of any of m. through q. wherein said texture is a plurality of linear sections disposed upon said surface of said leading edge device, said core contacting said linear sections when disposed between said leading edge device and said web material in contacting engagement with said upper winding roller.

s. The leading edge device of any of m. through r. wherein said texture is a plurality of linear sections disposed within said surface of said leading edge device, said core contacting said linear sections when disposed between said leading edge device and said web material in contacting engagement with said upper winding roller.

t. The leading edge device of any of m. through s. wherein said texture is a plurality of grooves disposed upon said surface of said leading edge device, said core contacting said grooves when disposed between said leading edge device and said web material in contacting engagement with said upper winding roller.

Any dimensions and/or values disclosed herein are not to be understood as being strictly limited to the exact dimensions and/or numerical values recited. Instead, unless otherwise specified, each such dimension and/or value is intended to mean both the recited dimension and/or value and a functionally equivalent range surrounding that dimension or value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An improvement to a surface winder for winding a web material around a core having a radius, R, to obtain a log, the surface winder comprising a glue applicator for dispensing glue onto said core, a core inserter for transporting and inserting said core provided with said glue disposed thereon into a winding cradle defined at a top by an upper winding roller, supplied from above with said web material directed towards said winding cradle at a velocity, v, and at a bottom by a concave cradle associated downstream to a lower winding roller, said surface winder comprising a third oscillating roller arranged above said lower winding roller, said upper winding roller, said lower winding roller, and said third oscillating roller each having a respective axes parallel to each other and perpendicular to the feeding direction of said web material and cooperating with each other downstream of said winding cradle in order to wind said web material around said core to obtain said log, said concave cradle comprising an introductory portion, the improvement comprising:

wherein said introductory portion of said concave cradle comprises a leading edge device, said leading edge device having a surface for contacting said core, said surface having a texture with protuberances provided thereto.

2. The improvement to a surface winder of claim 1 wherein said surface causes said core to rotate at an angular velocity, ω, wherein $v=R\omega$.

3. The improvement to a surface winder of claim 1 wherein said core contacts said leading edge device concurrently with contacting said web material in contacting engagement with said upper winding roller.

4. The improvement to a surface winder of claim 1 wherein said texture is a plurality of protuberances disposed upon said surface of said leading edge device, said core contacting said protuberances when disposed between said leading edge device and said web material in contacting engagement with said upper winding roller.

5. The improvement to a surface winder of claim 4 wherein each protuberance of said plurality of protuberances disposed upon said surface of said leading edge device are collectively elongate.

6. The improvement to a surface winder of claim 4 wherein each protuberance of said plurality of protuberances disposed upon said surface of said leading edge device are disposed randomly upon said surface of said leading edge.

7. The improvement to a surface winder of claim 4 wherein each protuberance of said plurality of protuberances disposed upon said surface of said leading edge device are disposed in a pattern upon said surface of said leading edge.

8. The improvement to a surface winder of claim 4 wherein each protuberance of said plurality of protuberances disposed upon said surface of said leading edge device are provided with a geometry, said geometry of each of said protuberances reducing slippage between said core and said surface of said leading edge device.

9. The improvement to a surface winder of claim 8 wherein said geometry is selected from the group consisting of pins, polyhedrons, and combinations thereof.

10. The improvement to a surface winder of claim 1 wherein said texture is a plurality of linear sections disposed upon said surface of said leading edge device, said core contacting said linear sections when disposed between said leading edge device and said web material in contacting engagement with said upper winding roller.

11. The improvement to a surface winder of claim 1 wherein said texture is a plurality of linear sections disposed within said surface of said leading edge device, said core contacting said linear sections when disposed between said leading edge device and said web material in contacting engagement with said upper winding roller.

12. The improvement to a surface winder of claim 1 wherein said texture is a plurality of grooves disposed upon said surface of said leading edge device, said core contacting said grooves when disposed between said leading edge device and said web material in contacting engagement with said upper winding roller.

13. A leading edge device for incorporation into an introductory portion of a concave cradle, said concave cradle being associated with an upper winding roller of a surface winder to form a winding cradle for winding a web material having a velocity, v, around a core having a radius, R, inserted therein to obtain a log, said leading edge device having a surface for contacting said core, said surface having a texture with protuberances provided thereto.

14. The leading edge device of claim 13 wherein said surface causes said core to rotate at an angular velocity, ω, wherein $v=R\omega$.

15. The leading edge device of claim 13 wherein said core contacts said leading edge device concurrently with contacting said web material.

16. The leading edge device of claim 13 wherein said texture is a plurality of protuberances disposed upon said surface of said leading edge device, said core contacting said protuberances when disposed between said leading edge device and said web material in contacting engagement with said upper winding roller.

17. The leading edge device of claim 16 wherein each protuberance of said plurality of protuberances disposed upon said surface of said leading edge device are provided with a geometry, said geometry of each of said protuberances reducing slippage between said core and said surface of said leading edge device.

18. The leading edge device of claim 13 wherein said texture is a plurality of linear sections disposed upon said surface of said leading edge device, said core contacting said linear sections when disposed between said leading edge device and said web material in contacting engagement with said upper winding roller.

19. The leading edge device of claim 13 wherein said texture is a plurality of linear sections disposed within said surface of said leading edge device, said core contacting said linear sections when disposed between said leading edge device and said web material in contacting engagement with said upper winding roller.

20. The leading edge device of claim 13 wherein said texture is a plurality of grooves disposed upon said surface of said leading edge device, said core contacting said grooves when disposed between said leading edge device and said web material in contacting engagement with said upper winding roller.

* * * * *